US005775390A

United States Patent [19]

Mohn

[11] Patent Number: 5,775,390

[45] Date of Patent: Jul. 7, 1998

[54] APPARATUS FOR EXTRACTION OF A FLUENT MATERIAL FROM A CONTAINER

[76] Inventor: Frank Mohn, 108 Coombe Lane, London SW20 OAY, England

[21] Appl. No.: 647,913

[22] PCT Filed: Nov. 30, 1994

[86] PCT No.: PCT/GB94/02672

§ 371 Date: Jun. 28, 1996

§ 102(e) Date: Jun. 28, 1996

[87] PCT Pub. No.: WO95/15280

PCT Pub. Date: Jun. 8, 1995

[30] Foreign Application Priority Data

Nov. 3, 1993 [GB] United Kingdom ..... 9324560

[51] Int. Cl.[6] ..... B65B 1/04

[52] U.S. Cl. ..... 141/329; 141/65; 141/98; 137/318; 137/320; 137/526; 114/50

[58] Field of Search ..... 141/329, 346, 141/347, 382, 383, 65, 67, 98; 114/50, 52, 74 R; 137/318, 320, 526

[56] References Cited

U.S. PATENT DOCUMENTS

| | | | |
|---|---|---|---|
| 3,335,742 | 8/1967 | Novak | 137/318 |
| 3,831,387 | 8/1974 | Rolleman . | |
| 3,890,796 | 6/1975 | Kruger et al. . | |
| 4,284,110 | 8/1981 | Divelbiss et al. . | |
| 4,719,937 | 1/1988 | Roche et al. | 137/526 |
| 5,277,232 | 1/1994 | Borsheim | 141/67 |
| 5,490,546 | 2/1996 | Lhoest | 141/346 |
| 5,546,979 | 8/1996 | Clark, II et al. | 137/318 |

*Primary Examiner*—Henry J. Recla
*Assistant Examiner*—Steven O. Douglas
*Attorney, Agent, or Firm*—Young & Thompson

[57] ABSTRACT

Apparatus for extracting fluent material from a container, for example to remove oil or toxic fluid from a submerged or sunken container, e.g., a tank in a sunken ship, has a device for locating (29) and securing (21, 27) the apparatus against a wall of such a container, a device for forming an aperture in the wall (15, 17), a device for extracting the fluid through the aperture, and a closure device for the aperture. Preferably the apparatus has two parts, a first upper module (1) comprising a driving device and a drilling or milling device (17) for making an aperture in the wall, and a second lower module (4), comprising the closure device (12) operable mechanically or hydraulically by the first module. The first and second modules are releasably connected together and can be separated under control of the first module. The apparatus is moved into position by thruster drive units (29) and may be guided remotely from a remote monitor connected to a video camera mounted on the apparatus. A method is also disclosed, in which the apparatus is secured to an upper portion of the container wall for removal of light fluids and to a lower portion for heavy fluids.

31 Claims, 3 Drawing Sheets

APPARATUS FOR EXTRACTION OF A FLUENT MATERIAL FROM A CONTAINER

BACKGROUND OF THE INVENTION

1. Field of the Invention

The invention relates to an apparatus for extraction of a fluent material from a container. The invention can be embodied in particular in an apparatus for extracting oil or other fluid from a submerged container, for example, a sunken oil tanker.

2. Description of the Related Art

There is known from U.S. Pat. No. 3,831,387 a salvage capsule for removal of oil from a sunken vessel with remotely controllable means for securely but detachably fixing the capsule in the decking or hull of the vessel in proximity to the compartment from which the oil is to be salvaged; drill means for providing access to the compartment through one or more openings, extensible oil suction pipe means for insertion into the compartment through the opening, first pump means for removing oil from the ship compartment into a holding chamber within the capsule and second pump means for removing oil from the holding chamber to the surface where it may be held in suitable storage such as balloons or salvage tankers.

This prior art salvage capsule is complicated in structure, and considerable time is required for the necessary sealing of the holes in the compartment prior to lifting the capsule.

Also, U.S. Pat. No. 4,284,110 describes an apparatus designed to serve a somewhat similar function but is diver assisted and less comprehensively equipped.

SUMMARY OF THE INVENTION

The present invention is concerned with the provision of apparatus for extraction of fluid or other fluent material from a container, for example an underwater container, which is able to meet all requirements for such apparatus in a simple and effective way.

The invention thus relates to an apparatus for removing fluent material from a container, the apparatus being of the kind comprising locating means for locating the apparatus against a wall of the container, securement means for securing the apparatus to the wall, means for forming an aperture through the wall and for extracting the material from the container through the aperture, and closure means for closing the aperture.

The invention accordingly provides an apparatus of this kind in which the necessary functions of the apparatus are divided between two separable modules. Thus, a first or active module comprises the means for extracting the material and for locating and securing a second, passive, module which includes the closure means, permanently to the container. The closure means can then be arranged to become effective in response to separation of the active module from the passive module, so in the event of adverse weather conditions or other emergency, the active module can be removed from the passive module with immediate consequential sealing of the container. As the active module can comprise virtually all the components of the apparatus which need servicing or replacement, maintenance of the apparatus is moreover facilitated by its modular structure. The closure means of the second module can be biassed to the closed position and held open as long as the modules are connected together by mechanical or fluid pressure operated means.

The invention also provides an apparatus of the kind described in which undue low pressure within the container consequential on withdrawal of the fluent material, which could lead to collapse of the container, is avoided by pressure compensation means. Such pressure compensation means can effect replacement of the extracted material through a non-return valve, which allows sea-water or other ambient fluid to enter the container as the fluent material is withdrawn from it. Conveniently, the fluent material is extracted through a suction device extending with clearance through the container wall aperture, so that the extracted material can be replaced by fluid flow between the suction device and the aperture edge.

Where the apparatus of the invention is divided into separable active and passive modules, the passive module can take one of two forms. Where pressure compensation is required a non-return valve may be located on the passive module. The passive module can instead be constructed without the inlet non-return valve where replacement of the extracted material is not appropriate, or is not required.

The apparatus of the invention can thus comprise an upper module, releasably carrying a lower module, and which can be guided to engage the lower module with the container wall. Securement of the lower module to the wall is then effected, conveniently by means of a plurality of assemblies combining drills, thread cutters and bolts. The lower module can be secured and sealed to the container by the bolts which are retained in the holes drilled in the container wall and threaded by the thread cutters of the assemblies. The securement assemblies can be carried in the upper module by drive units which can be separated from the bolts on separation of the modules.

The upper module also supports a fluid extraction unit comprising cutting and pumping means whereby the aperture is formed in the container wall and the fluent material is pumped out and transferred by way of a hose to a surface vessel from which the apparatus is supplied, or to some other suitable container.

The invention also provides a fluid extraction unit comprising a rotatable combined hole forming/impeller assembly. Although such a fluid extraction unit is advantageously employed in the apparatus of the invention, it can be employed independently elsewhere for example in emergency equipment for use in removing hazardous fluids from a container which needs to be quickly emptied as because of a fire risk. The assembly can thus comprise a rotatable sleeve which can be advanced towards the container, the leading end of the sleeve having cutting elements which can form a hole in the container wall or milling elements when it is undesirable that a cut-out portion of the container wall should fall within the container. Inwardly of the cutting or milling elements, the sleeve contains impeller means so that continued rotation of the sleeve after the container wall has been penetrated withdraws fluent material from the container, the sleeve thus acting as a rotatable suction device.

The lower module has a closeable aperture through which a suction device of the fluid extraction means can extend from the upper module into the container, the closure means for the aperture can be biassed to the closed position and maintained in the open condition only as long as the two modules are connected together. The closure means can be held open mechanically or by fluid pressure from the upper module. Conveniently the closeable aperture of a lower module can be an outer one of two aligned apertures extending through a compartment or chamber of the lower module into which water can flow through a non-return valve into the container if required, as mentioned above.

The upper and lower modules are releasably connected together by latching means operable from the upper module. When it is desired to raise the upper module from the underwater container, the latching means are released and the upper module is moved away from the container either by suspension wires or by use of thrusters with which it is provided. The lower module remains secured to the container and the separation of the upper module from the lower module effects closure of the lower module aperture, for example, mechanically or by discontinuing the supply of pressure fluid which has maintained the lower module aperture open. With the lower module aperture closed, the container is sealed off from the water around it. Withdrawal of the upper module is thus very easily and quickly effected. If the separation of the two modules is temporary only, for example because of adverse weather conditions or the need to service a component of the upper module, extraction of the material from the container can be readily resumed by guiding the upper module back to its previous position in engagement with the lower module. The two modules can be latched together by the latching means and the suction device advanced through the lower module into the container again, the lower module aperture having been opened mechanically or by fluid pressure from the upper module as a consequence of the re-engagement of the modules.

The apparatus of the invention can be positioned to engage with the container by being lowered from the deck of the surface vessel and directly located against the container by thrusters suitably mounted on it. Television cameras on the apparatus can indicate to the surface vessel the actual relationship of the apparatus to the underwater container and confirm correct remote controlled operation of the device. If the material to be extracted from the container is a fluid lighter than the surrounding seawater, the extracting apparatus is moved to an upper position on the container. If the fluid within the container is heavier than the surrounding water the apparatus is engaged with the container at a lower position.

BRIEF DESCRIPTION OF THE DRAWINGS

The invention is further described below, by way of example only, with reference to the accompanying drawings, in which.

DESCRIPTION OF THE PREFERRED EMBODIMENT

Figure 1:
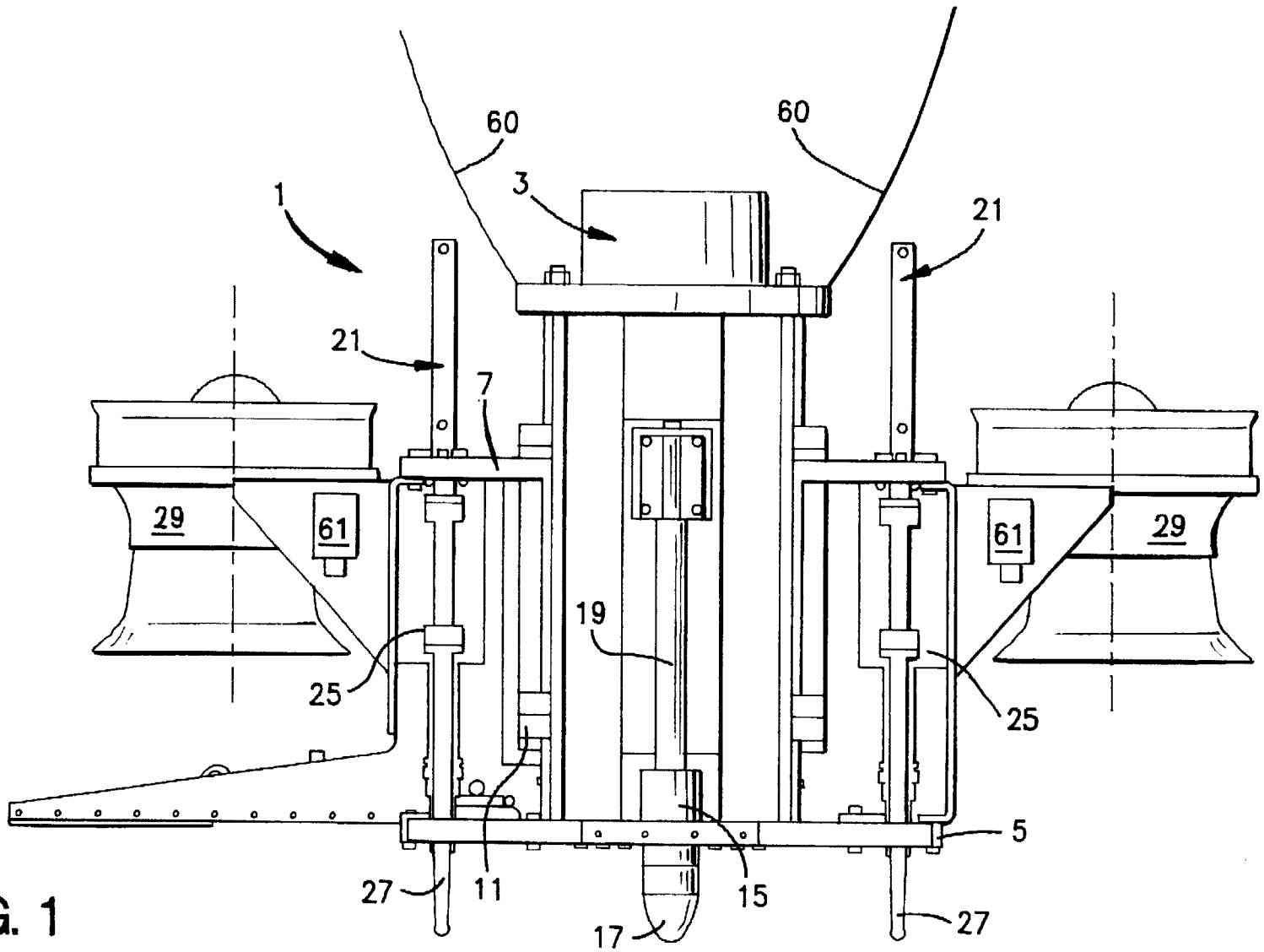
FIG. 1 is a side view of an upper or active module which forms an apparatus in accordance with the invention in combination with a lower or passive module.
Figure 3:
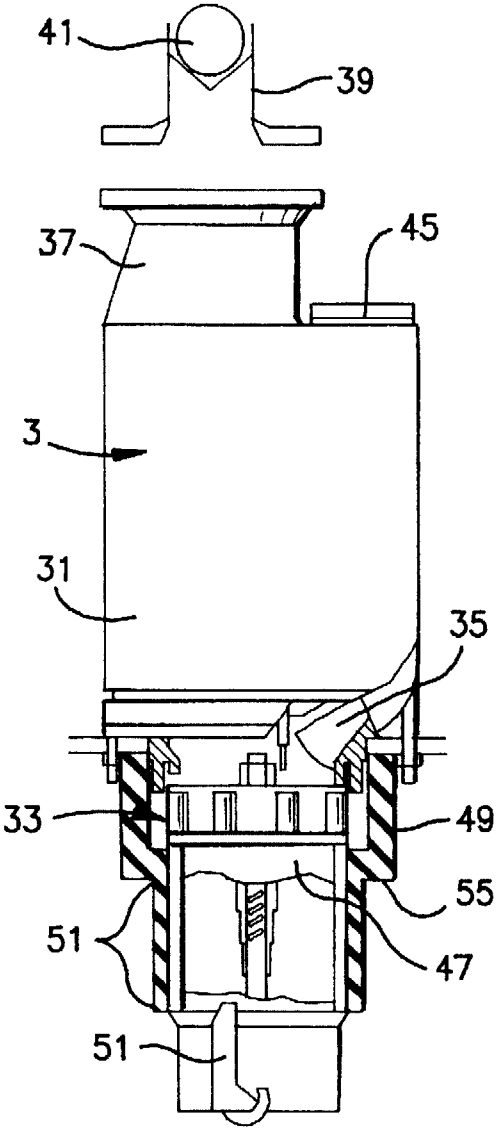
FIG. 3 is a side view, partly in section, of a fluid extraction unit included in the active module of FIGS. 1 & 2.
Figure 2:
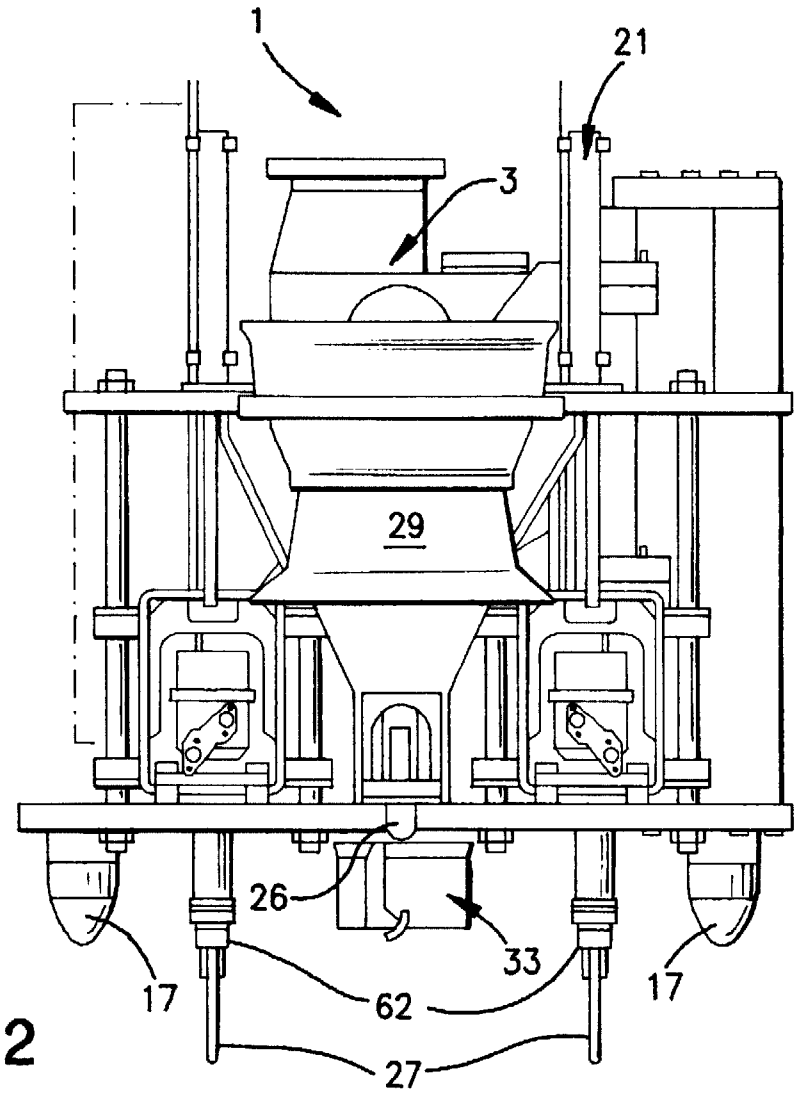
FIG. 2 is a second side view of the active module from a position angularly spaced by 90° from that of FIG. 1.

The active module 1 of the apparatus illustrated in FIGS. 1 & 2 comprises a platform 5 supporting above it the fluid extraction unit 3 illustrated in FIG. 3 by way of a support frame 7. The extraction unit 3 is mounted in the frame for selective movement along its axis through a central aperture in the platform 5 by twin guidance units 11 and hydraulic means 19.

The platform or support frame also mounts two selectively operable connector units 15 at positions spaced apart along a diameter of the aperture, one on each side. The connector units 15 extend through respective apertures in the platform and comprise locking dogs 17 below the platform which are operable for connection or disconnection of the lower module.

The platform 5 also supports four drill units 21 spaced around the central aperture. Each drill unit 21 comprises a drive motor and operating cylinder 25 above the platform and a locking drill bit 27 extending below the platform through an aperture. The locking drill bit combines a drill portion for forming a hole, a thread cutter portion for tamping the drilled hole, and a bolt portion to be screw-threaded into the tapped hole. The locking drill bit can be separated from and re-engaged with the drive motor 25 via collar 62.

The support frame 7 also mounts two thrusters 29 above the platform to position the apparatus on to the container wall. Television cameras 61 on the apparatus can indicate to the surface vessel the actual relationship of the apparatus to the underwater container and confirm correct remote controlled operation of the device.

The extraction unit 3 comprises a generally cylindrical housing 31 containing an hydraulic or electric motor of which the drive shaft protrudes downwardly along the axis of the housing to rotatably drive a cutter/impeller assembly 33 having impellers 35. Rotation of the assembly 33 by the motor causes fluid entering from below to move upwardly within the housing to a fluid outlet 37 at the top of the casing. The fluid outlet communicates with a hose 39 leading upwardly in use to a surface vessel from which the illustrated apparatus is controlled and supplied. A non-return valve 41 prevents back-flow in the event of an aborted extraction operation or failure of the pump for any reason. Power is supplied to the electric motor of the unit 3 from the surface vessel through an hydraulic and/or electric umbilical connection 45. Pressure fluid for operating the various components of the upper module can also be supplied from the surface vessel by way of this umbilical connection, or the fluid pressure can be generated within the module.

The cutter/impeller 33 assembly includes a sleeve portion 47 around the drive shaft so as to define within it an annular space for upward flow of the pumped material. The assembly 33 is received within a cylindrical casing 49 having an out-turned flange at its upper end by which it is bolted to the lower end of the housing 31. The casing 49 has a lower end portion of reduced diameter within which the impeller sleeve portion 47 is journalled. Seals 51 are provided between the sleeve portion 47 and the lower casing portion at the upper and lower ends of the latter.

The sleeve portion 47 extends outwardly beyond the lower end of the casing 49 and mounts at its protruding lower end a plurality of cutter elements 51 capable of cutting or milling a hole through a metal plate on the rotation of the assembly 33.

Figure 4:
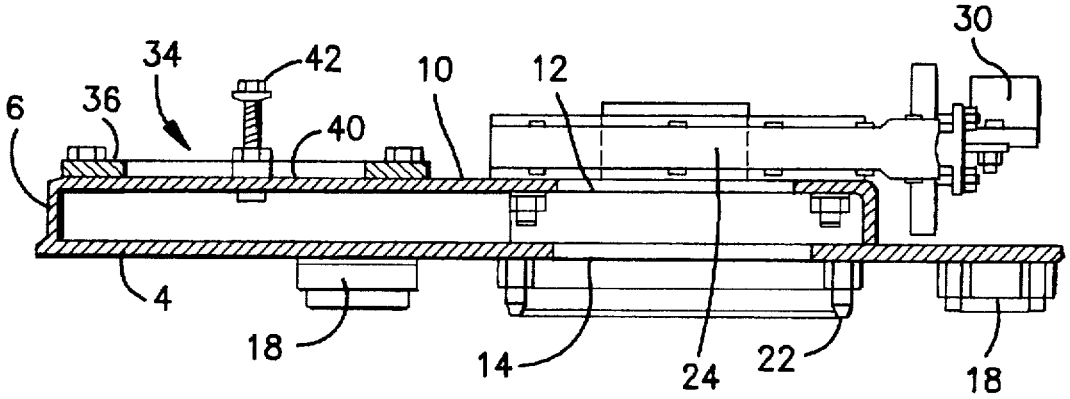
FIGS. 4 & 5 are a sectional side view and a plan view respectively of a lower or passive pressure compensation module for use in combination with the active module of FIGS. 1 & 2.
Figure 5:
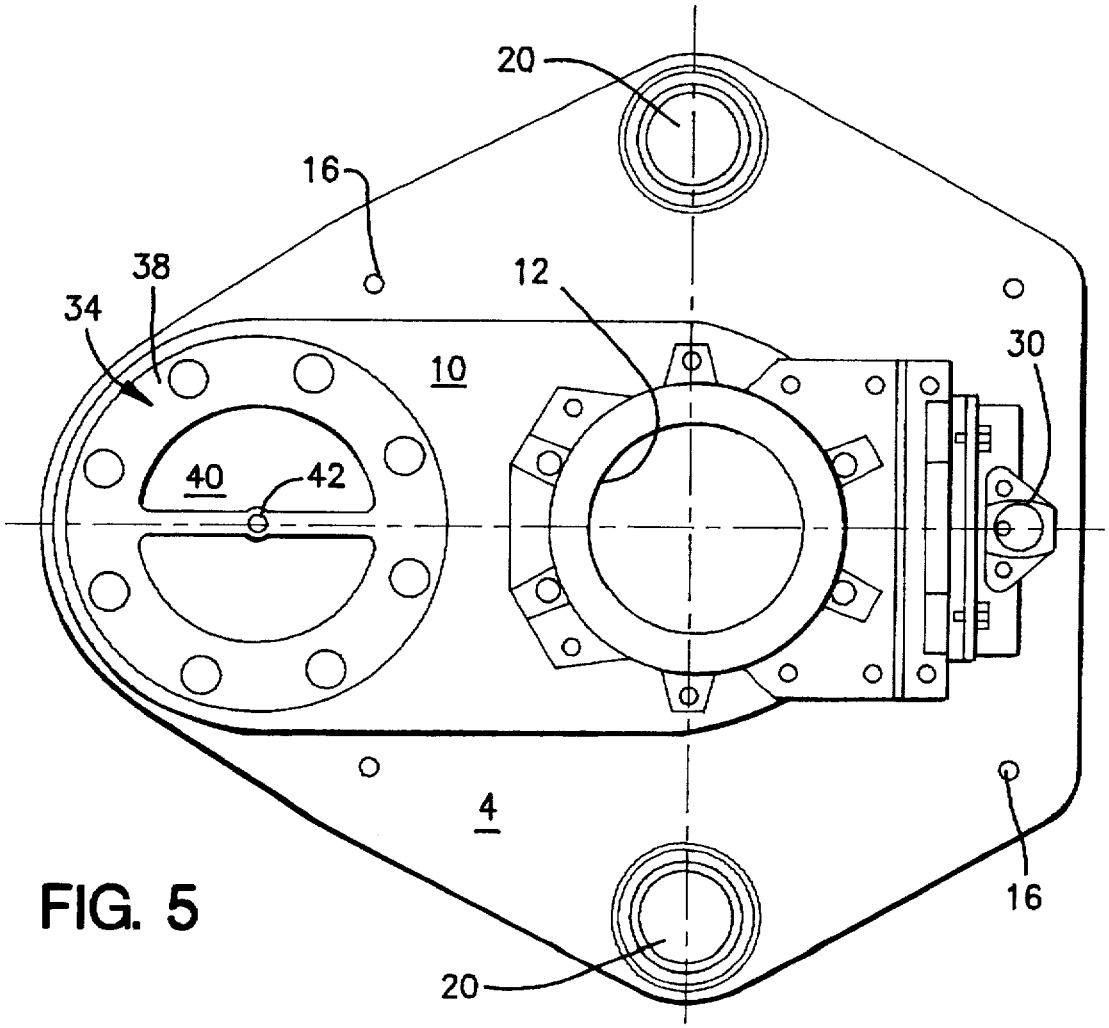

The lower or passive module of FIGS. 4 & 5 comprises a base plate 4 from which upstands a rim 6 having two spaced parallel side portions joined by semi-circular end portions. The rim 6 forms with the base plate 4 a flat compartment closed by a top plate 10 extending parallel to the base plate.

At one end of the compartment, aligned circular apertures 12 & 14 in the top and base plates respectively allow for passage therethrough of the cutter/impeller assembly 33 and the lower casing portion of the fluid extraction unit 3 when the modules are assembled together.

In this condition, the apertures in the platform 5 through which the drill bits 27 extend register with corresponding holes 16 through the base plate externally of the compartment. Beneath the base plate, annular seals 18 are provided for sealing the base plate to the wall of the container around the holes caused by the drill bits 27.

The base plate 4 is also provided with apertures 20 for receiving the locking dogs 17, whereby the modules can be releasably secured together. An annular environmental seal 22 is provided around the aperture 14 of the base plate against the container wall and the aligned aperture 12 in the top plate 6 is associated with a closure device 24 which can be biassed to seal off the aperture as a consequence of separation of the two modules. When the modules are connected together, the closure device can be held in the open condition, mechanically, or as shown by pressure fluid supplied from the upper module by way of an operating lever 26 on the upper module and a receiving aperture 30 on the lower module.

At the other end of the lower module compartment, a circular aperture in the top plate accommodates a non-return valve 34 permitting entry of fluid into the compartment but preventing flow outwardly thereof. The non-return valve 34 can take the form as shown, of a rubber washer 36 clamped to the top plate around the aperture by an annular member 38 with a web extending across it by which a rigid valve plate 40 is held against the washer by a spring around a bolt 42 secured to the valve plate and extending through an aperture in the web. The valve will thus open in response to a predetermined pressure difference on the two sides of the valve plate 40 determined by the spring. When open, the non-return valve admits fluid into the compartment, from which the fluid can be drawn through the base plate aperture 14 into the container.

In use of the illustrated apparatus, the two modules, connected together by the connection units 15 are lowered from the surface vessel to the vicinity of the underwater container from which fluent material is to be extracted. The apparatus can be deployed by guide wire 60, or be a free-swimming, self-propelled apparatus operated and controlled remotely from the surface vessel by means of a power control umbilical, which can include hydraulic and/or electrical power and/or control cables. The apparatus is then Positioned so as to engage the underside of the lower module with the container wall. The wall can be at the underside of the container if need be and the references herein to the upper and lower module refer only to the orientation of the apparatus as illustrated, or when landed on an upper wall of the container.

When adjacent the container, the apparatus is urged against the wall by the thrusters 29 and the drill units 21 are set in operation to lock the lower module to the container wall. The fluid extraction unit 3 is then activated and advanced by the hydraulic units 11 so that the cutter/impeller assembly 33 engages the wall and cuts or mills an aperture in it. Immediately access to the container interior is obtained in this way, fluid within the container is pumped out by the impeller vanes 35 of the cutter/impeller assembly. The step between the two portions of the lower casing 49 carries a seal 55 which engages against the top of the closure device of the lower module. The compartment thus communicates with the container interior through the annular space around the cutter/impeller assembly 33.

The non-return valve 34 provided on the pressure compensation lower module will open if pressure within the container and compartment falls below a predetermined level, to admit ambient water to balance the pressure drop due to the extraction of the fluid. Where this facility is not required, a lower module is provided in which the non-return valve 34 need not be installed.

When fluid extraction has been completed or is to be interrupted for any reason, the locking dogs 17 are released by operation of the connection units 21 and the upper module is moved away from the container, as by energisation of the thrusters 29. The modules separate, leaving the lower module securely locked to the container, with the compartment sealed by the closure means 24, which may operate automatically as a consequence of the separation. Fluid extraction can be resumed at any time by returning the upper module to juxtaposition with the lower module, operating the connection units 15 to latch the two modules together, and advancing and activating the cutter/impeller assembly 33.

The invention can be embodied otherwise than as specifically described and illustrated.

I claim:

1. An apparatus for removing fluent material from a container, he apparatus comprising locating means for locating the apparatus against a wall of the container, securement means for securing the apparatus to the wall, means for forming an aperture through the wall and for extracting the material from the container through the aperture, and closure means for closing the aperture, comprising a first module having the means for extracting the material and for locating and securing a second module to the container, the second module having closure means, the first and second modules being releasably connectable one to the other, and wherein the closure means of the second module is adapted to become effective in response to separation of the first module from the second module.

2. An apparatus according to claim i, wherein the closure means is adapted to be biased to a closed condition and wherein means are provided on the first module for maintaining the closure means open when the first module is connected to the second module.

3. An apparatus according to claim 1 comprising pressure compensation means.

4. An apparatus according to claim 3, wherein said pressure compensation means comprises a non-return valve.

5. An apparatus according to claim 3, wherein the aperture forming and extraction means is arranged such that extraction and pressure compensation may be effected in respective coaxial conduits through the container wall aperture.

6. An apparatus according to claim 5, wherein the pressure compensation means is located in or on the second module.

7. An apparatus according to claim 1 comprising means for guiding the first module for engaging the second module with a container wall.

8. An apparatus according to claim 1, wherein the securement means comprises at least one drill, at least one thread cutter and a plurality of bolts.

9. An apparatus according to claim 1, wherein the first module comprises drive units arranged to carry the securement means and wherein means are provided for separating the drive units from the secured second module in response to separation of the modules.

10. An apparatus according to claim 1, wherein the aperture forming and extraction means comprises cutting and pumping means and a hose for connection to a remote storage tank for receiving the extracted fluid.

11. An apparatus according to claim 10 comprising a rotatable sleeve, means for advancing the sleeve toward a container from which fluid is to be extracted, and aperture forming elements on the leading edge of the sleeve.

12. An apparatus according to claim 11, wherein the sleeve contains impeller means inwardly of the aperture forming elements for withdrawing fluid from the container by rotation of the sleeve.

13. An apparatus according to claim 11, wherein the aperture forming elements comprises cutting elements.

14. An apparatus according to claim 11, wherein the aperture forming elements comprise milling elements.

15. An apparatus according to claim 1, wherein the second module comprises an aperture for receiving and guiding the extraction means of the first module to the container, the aperture being closeable by the closure means.

16. An apparatus according to claim 15, comprising means for biasing the closure means to a closed position and means for maintaining the closure means in an open condition as long as the first and second modules are connected together.

17. An apparatus according to claim 16, wherein the means for maintaining the closure means open operates mechanically.

18. An apparatus according to claim 16, wherein the means for maintaining the closure means open operates by fluid pressure applied by the first module.

19. An apparatus according to claim 15 comprising two coaxial aligned apertures, the outer one of which comprises the closeable aperture, and the inner one of which is connected by a non-return valve to the container.

20. An apparatus according to claim 1 comprising latching means operable from the first module for releasably connecting the first and second modules.

21. An apparatus according to claim 1, wherein the first module comprises means for moving the first module away from the second module after separation of the two modules.

22. An apparatus according to claim 21, wherein the moving means comprises thruster units.

23. An apparatus according to claim 21, wherein the moving means comprises suspension wires.

24. Apparatus according to claim 1 further comprising video monitoring means connected to remotely located display means to provide a visual indication to a remotely located operator of the positional relationship of the apparatus and the container.

25. A method of operating apparatus according to claim 1 comprising locating the apparatus against a wall of a container from which fluent material is to be removed, securing the apparatus to the wall, forming an aperture through the wall and extracting the material from the container through the aperture and subsequently closing the aperture.

26. A method according to claim 25 comprising driving the apparatus and locating the second module on a wall of the container, securing the second module to the container, forming an aperture in the wall of the container, extracting the fluent material and withdrawing the extraction means from the conrtainer and second module, operating the closure means on the second module to seal the aperture and withdrawing the first module to a location remote from the second module.

27. A method according to claim 26 comprising using the first module to secure the second module to the container.

28. A method of operating apparatus according to claim 1 comprising locating the apparatus against a wall of the container from which fluent material is to be removed, securing the second module to the side of the container, extracting fluent material from the container, separating the first module from the second module, and effecting operation of the closure means of the second module.

29. A method according to claim 28 for extracting a fluent material from a submerged container in which the fluent material in the container is lighter than the fluent material in which the container is located, the method comprising locating the apparatus on an upper wall portion of the container.

30. A method according to claim 28 for extracting as fluent material from a submersed container in which the fluent material in the container is heavier than that in which the container is located, the method comprising locating the apparatus on the lower wall portion of the container.

31. An apparatus for removing fluent material from a container, the apparatus comprising a rotatable sleeve, and means for advancing the sleeve toward a container from which material is to be extracted, wherein an aperture forming element is provided on the leading end of the sleeve for forming a hole in the container, and impeller means are provided in the sleeve, inwardly of the leading end, the impeller means being operable by rotation of the sleeve to withdraw fluent material from the container, the apparatus comprising a first module having means for locating and securing a second module to the container and the second module having closure means.

* * * * *